US009915071B2

(12) United States Patent
Heintzman

(10) Patent No.: US 9,915,071 B2
(45) Date of Patent: Mar. 13, 2018

(54) ROOF ICE DIVERTER

(71) Applicant: Rick Heintzman, Moorhead, MN (US)

(72) Inventor: Rick Heintzman, Moorhead, MN (US)

( * ) Notice: Subject to any disclaimer, the term of this patent is extended or adjusted under 35 U.S.C. 154(b) by 0 days.

(21) Appl. No.: 14/999,764

(22) Filed: Jun. 23, 2016

(65) Prior Publication Data

US 2017/0370106 A1 Dec. 28, 2017

(51) Int. Cl.

| | |
|---|---|
| ***E04D 13/10*** | (2006.01) |
| ***E04B 7/02*** | (2006.01) |
| ***E04B 1/92*** | (2006.01) |

(52) U.S. Cl.

CPC ..... *E04D 13/10* (2013.01); *E04B 1/92* (2013.01); *E04B 7/02* (2013.01)

(58) Field of Classification Search

CPC ..... E04D 13/10; E04B 7/02; E04B 1/92
See application file for complete search history.

(56) References Cited

U.S. PATENT DOCUMENTS

| | | | | | |
|---|---|---|---|---|---|
| 529,774 | A * | 11/1894 | Baird | E04D 13/10 | 52/25 |
| 1,047,332 | A * | 12/1912 | Tebbetts | E04G 3/26 | 248/237 |
| 1,154,855 | A * | 9/1915 | Gallup | E04G 3/26 | 248/237 |
| 2,320,538 | A * | 6/1943 | Vogt | E04G 3/26 | 182/45 |
| 4,542,874 | A * | 9/1985 | Ronning | E06C 7/16 | 182/121 |
| 4,884,775 | A * | 12/1989 | Fischer, Jr. | E04G 3/26 | 182/45 |
| 5,044,130 | A * | 9/1991 | Chiddister | E04D 13/10 | 52/24 |
| D397,809 | S * | 9/1998 | Nelson | D25/199 | |
| 5,943,826 | A * | 8/1999 | Totin | E04D 13/10 | 52/24 |
| 6,045,102 | A * | 4/2000 | Terenzoni | E04D 15/00 | 182/107 |
| 6,453,623 | B1 * | 9/2002 | Nelson | E04D 13/10 | 411/432 |
| 6,729,101 | B2 * | 5/2004 | Macri | E04D 13/12 | 182/45 |
| D657,236 | S * | 4/2012 | Knutsen | E04D 13/10 | D8/499 |

(Continued)

*Primary Examiner* — Brian E Glessner
*Assistant Examiner* — Omar F Hijaz
(74) *Attorney, Agent, or Firm* — DL Tschida

(57) ABSTRACT

An assembly having a longitudinal webbed base plate, upright webbed diverter (e.g. "V"-shaped) and coupling stabilizer and brace arms that assemble to extend from a roof above typical snow cover depths to protect downstream appliances protruding from the roof from snow/ice slide damage. The base plate and/or stabilizer arm includes surfaces shaped to promote the scoring and shearing of a snow/ice slide prior to the sheared sections of the snow/ice being laterally displaced away from a downstream appliance via the upright diverter. Alternative serrated, saw tooth, pointed, spiked and wedged shear surfaces are formed into the base plate and/or a single or multi-section stabilizer arm. An appliance cover piece can be fitted to the upright diverter and suspended above the downstream appliance.

15 Claims, 7 Drawing Sheets

(56) References Cited

U.S. PATENT DOCUMENTS

| | | | | |
|---|---|---|---|---|
| 8,636,109 | B2 * | 1/2014 | Wallace | E04G 3/265<br>182/45 |
| D757,924 | S * | 5/2016 | Briggs | E04D 13/10<br>D23/386 |
| 2005/0044752 | A1 * | 3/2005 | Thaler | E04D 13/10<br>37/196 |

* cited by examiner

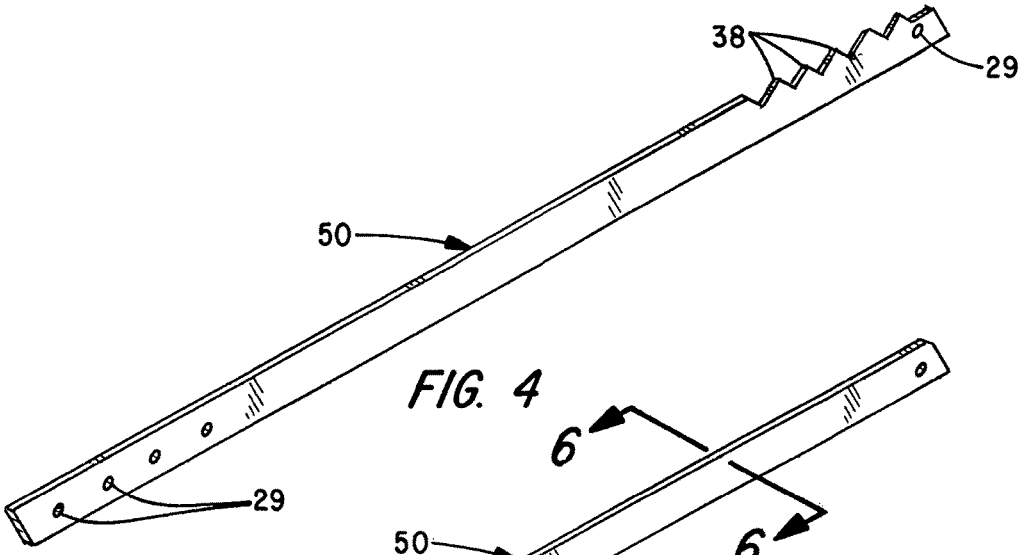
FIG. 4
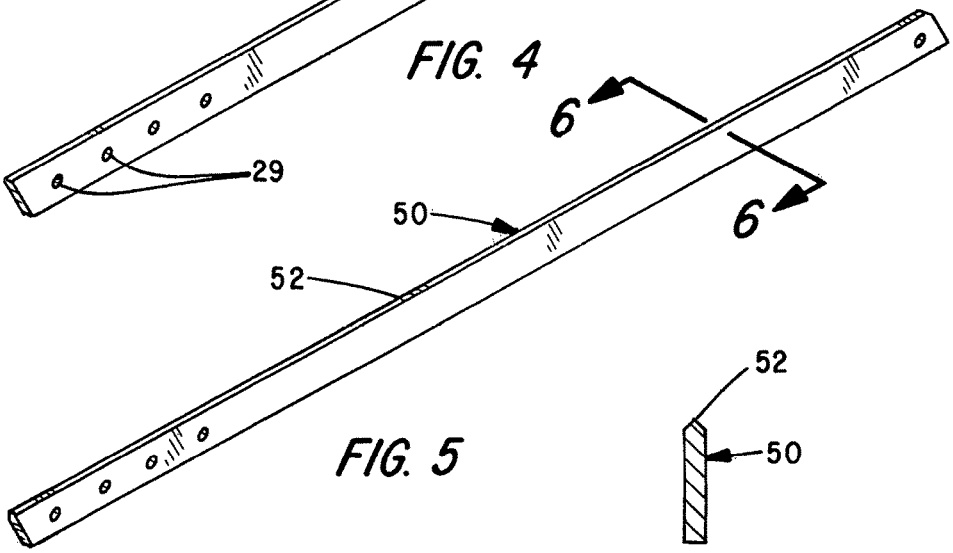
FIG. 5
FIG. 6
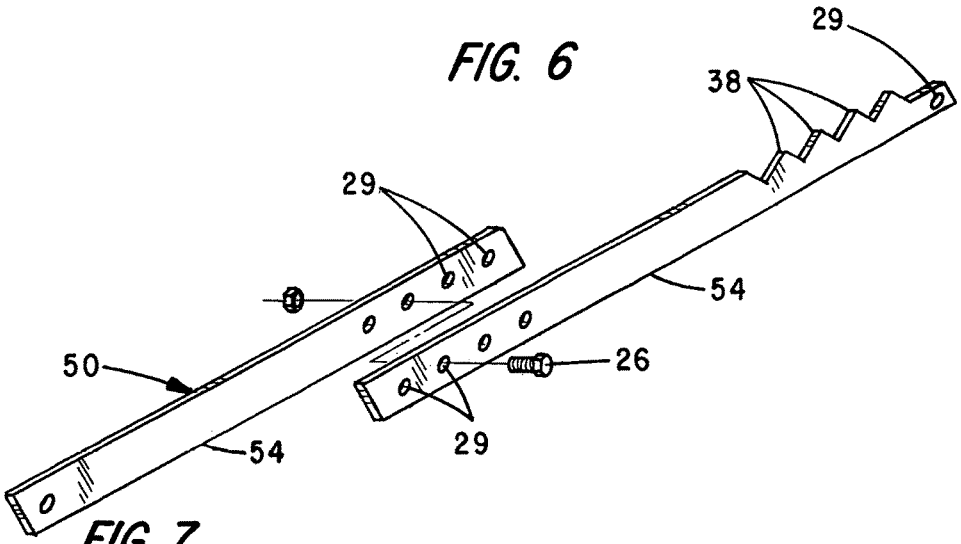
FIG. 7

ROOF ICE DIVERTER

BACKGROUND OF THE INVENTION

The present invention relates to snow and ice load control devices for roofs and in particular to an assembly attachable to roofs susceptible to ice build-up for protecting protruding plumbing vent pipes, chimneys, HVAC appliances, gutters and the like mounted to project from the roof from damage due to snow and ice slides.

Roofs found in geographic locales that experience snow and ice conditions are constructed to withstand the added weight of typical snow and ice that can buildup on the roofs during the winter months. For some roofs, the weight of the snow/ice can build over time to damage the building interior from leaks that arise from ice dams and other conditions. For some roofs, sheets of the snow/ice can slide from the roofs and injure nearby persons or damage property affixed to the roof or in close proximity to the building eaves. Metal and fiberglass panel roofs are particularly susceptible to snow/ice slides.

Metal roofs, such as typically made from steel panels, are frequently found on outbuildings at farms, ranches and in commercial warehouse and office sites. Metal panel roofing is also used with a variety of residential building applications. Such roofing offers durability, cost and installation advantages. Depending upon the climate and especially for sites subject to relatively heavy annual snow falls, the roofs are periodically susceptible to snow removal via snow slides, especially for relatively steeply pitched roofs of 5×12 or greater pitches. The steeper pitch enhances the gravitational effect on the snow/ice upon exposure to sun and wind and the natural inclination of the snow/ice to detach and slide from the roof. Snow/ice loading is thereby alleviated but at the expense of possible damage to structures in the slide path either on the roof or ground.

The panels can be used with less steeply pitched roofs but associated framing may have to be increased depending upon typical snow/ice loading. Less steeply pitched roofs are particularly common on large buildings. For example, buildings that are 50' wide by 100' long may have a 4×12 pitch and buildings 70' wide by 150' and longer may have a 3×12 pitch.

The framing design of buildings and roofs found in snow country typically position chimneys, plumbing vents and other vertically protruding structures relatively high up the roof and close to the peak. Because any vertical protuberance is subject to contact with any snow or ice sliding from the roof a higher mounting limits the volume and weight of snow/ice contacting the appliance during slide or avalanche conditions. It is not however always possible to place the protruding appliance near the peak. Consequently, when large heavy weight slides occur, the protruding appliances can be exposed to high shear stresses that can dislodge, detach or crush the appliance and/or tear a large hole in the roof.

Depending upon the severity of any damage, leaks can occur at the appliance or in the vicinity of the booted flashings typically used in association with the appliance. The leaks may or may not be readily detected, but will eventually become apparent when water from subsequent snow melt or rain enters the building and drains through lower lying ceilings, walls, fixtures etc.

A variety of devices have been developed to retain snow to the roof to prevent unwanted slide conditions. Such devices provide surfaces designed to hold the snow to the roof and assume the snow will melt without producing slide or avalanche conditions.

Other devices have been developed to shear and breakup the sliding snow and ice during slide conditions to protect associated rain gutters. Such devices are designed with relatively shallow height profiles and merely shear the snow/ice slide close to the roof (i.e. 3-4 inches). These devices are typically positioned near the roof edges to breakup the slide front to reduce stresses on gutter systems supported from the roof edges. U.S. Pat. Nos. 2,129,833 and 5,044,130 disclose two of such devices.

As noted from the patent disclosures, multiples of the foregoing devices are typically mounted in a patterned placement between the pitched metal panel seams of the roof being protected, such as in rows and columns. One or more devices can be mounted in each seam space at desired distances from the roof edge. Although the shearing devices may reduce the size and mass of a sliding sheet of ice into multiple layers prior to striking any attached gutter, the upper layer of each sheet of sliding snow/ice can still encounter vertical appliances such as vent pipes and chimneys. The shearing forces placed on the protruding structures can damage the structures, roof and/or any associated scals or flashings.

The ice and snow diverters of the present invention were developed to provide assemblies specifically intended for mounting upstream of plumbing vent pipes, chimneys, antennas, HVAC structures that protrude through or mount to a roof. The diverters are constructed to mount upstream of each desired protuberance to (1) vertically shear the full height of any snow/ice slide and (2) laterally divert the sheared pieces away from the sides of any downstream vent pipe, chimney or the like.

The diverter assemblies particularly include a V-shaped diverter plate designed to vertically project above normal snow/ice depths and any downstream protruding structure(s) to protect the protruding structure. Accessory wing pieces can be added to the diverter webs to enhance the lateral and vertical displacement forces of the diverter.

The diverter assemblies of the invention include serrated stabilizing shear arms constructed to withstand heavy weight. Fasteners and seals secured to a base plate and associated spreader arm(s) secure the diverter assemblies directly to the roof framing members (e.g. trusses and purlins) to prevent damage to the underlying roof panel.

SUMMARY OF THE INVENTION

It is a primary object of the invention to provide a device for protecting vertically protruding plumbing vent pipes, chimneys, antennas, HVAC appliances and the like mounted to project through or above roofs susceptible to ice build-up from damage due to shearing forces that occur with snow and ice slides.

It is a further object of the invention to provide a diverter device having means that extend above the typical snow cover for shearing or breaking the front face of a snow/ice slide into smaller sections.

It is a further object of the invention to provide a diverter device having means for laterally diverting sheared sections of a snow/ice slide away from downstream appliances or protuberances that project from or above the roof.

It is a further object of the invention to provide a diverter device having means for securing the device to roof framing members to withstand the shearing forces of a snow/ice slide and to be able to laterally divert sheared snow/ice away from downstream appliances or protuberances that project from or above the roof.

It is a further object of the invention to provide a diverter device having a longitudinal stabilizer arm that attaches to a webbed upright diverter (e.g. V-shaped) and includes a serrated or wedged edge surface shaped to promote scoring and shearing a snow/ice slide into smaller sections.

It is a further object of the invention to provide a diverter device having a longitudinal base plate that attaches to a webbed upright diverter piece (e.g. V-shaped) and wherein the base plate includes a serrated edge surface having a plurality of teeth and/or a wedged edge shaped to promote scoring and shearing a snow/ice slide into smaller sections.

It is a further object of the invention to provide a diverter having a longitudinal stabilizer arm coupling a base plate to a webbed upright diverter piece which arm may include a serrated or wedge shaped edge surface and/or means to vary the angular orientation of the stabilizer arm relative to the upright diverter.

It is a further object of the invention to provide a diverter device having accessory wings capable of mounting to the sides or top of upright webs of a V-shaped diverter piece to increase the width and/or height of the webs relative to a protruding downstream appliance.

It is a further object of the invention to provide a diverter device having a cap or cover piece that mounts to an upright webbed diverter piece and longitudinally extends to cover a downstream open-ended vent or chimney pipe.

It is a further object of the invention to provide seals to isolate and waterproof fasteners attaching a snow/ice diverter device to a roof.

The foregoing objects, advantages and distinctions of the invention are obtained in a snow and ice diverter assembly adapted for use with any roof susceptible to snow and ice slides. In one construction, the assembly comprises a longitudinal webbed base plate (e.g. "L" or "T"-shaped) that attaches to a roof. A stabilizer arm is mounted to the base plate and extends at an acute angle to an upright webbed diverter piece. The diverter piece includes intersecting web pieces and exhibits a V-shape or other desired angular orientation between the web pieces to laterally direct snow/ice away from a downstream appliance. The diverter piece exhibits a height accommodating normally anticipated snow depths or substantially the same as a protected appliance. The base plate and/or stabilizer arm includes serrated surfaces shaped to promote shearing a snow/ice slide front prior to the sheared front impinging on the upright diverter piece. The webbed wings of the diverter piece are positioned to laterally direct the severed snow/ice sections away from protruding downstream appliances and limit contact of the snow/ice with the appliance.

A cap or cover piece can be fitted to the diverter piece and/or an open-ended downstream vent or chimney pipe to overlie the pipe bore. The stabilizer arm can be constructed of one or multiple interconnecting pieces to permit length adjustments and extend between the base plate and diverter piece at a desired angular orientation. The base plate and/or stabilizer arm piece(s) can include surfaces (e.g. serrated, pointed, saw tooth, spiked, wedged etc.) shaped to promote scoring, shearing and separation of any snow/ice encountering the diverter assembly.

A variety of alternative configurations and combinations of the foregoing features of the inventive snow/ice diverter can be constructed. For example, the base plate can comprise a webbed member that exhibits an "L" or "T"-shaped cross-sectional profile and can include shaped shearing surfaces (e.g. serrated, saw tooth, spiked, wedged etc.). The stabilizer arm can be constructed to be length adjustable and to include shaped shearing surfaces. Accessory wing pieces can be fitted to the diverter plate to increase its height and/or promote a greater lateral separation of sheared ice sections to prevent contact with a protected vertical vent pipe, chimney or other appliance. A cover piece can be mounted to the diverter plate and extend to cover an open bore of a protected vertical appliance (e.g. vent pipe).

Still other objects, advantages, distinctions, constructions and combinations of individual features of the invention will become more apparent from the following description with respect to the appended drawings. Similar components and assemblies are referred to in the various drawings with similar alphanumeric reference characters. The description to each combination should therefore not be literally construed in limitation of the invention. It is also to be appreciated the singular improvements can be combined in any variety of track assemblies. The invention should therefore be interpreted within the broad scope of the further appended claims.

BRIEF DESCRIPTION OF THE DRAWINGS

FIG. 4 shows a perspective view of the support arm and a serrated or saw tooth ice shearing edge.

FIG. 5 shows a perspective view of an alternative support arm having a wedge-shaped ice shearing edge.

FIG. 6 shows a cross section view taken along reference lines 6-6 of FIG. 5 and depicting an enlarged view of wedge-shaped ice shearing edge.

FIG. 7 shows a perspective view of an alternative multi-section support arm having a serrated ice shearing edge that permits length adjustment of the arm and relative support angle to the diverter piece and wherein the arm's aft end section can support an appliance cover.

DESCRIPTION OF THE PREFERRED EMBODIMENTS

Figure 1:
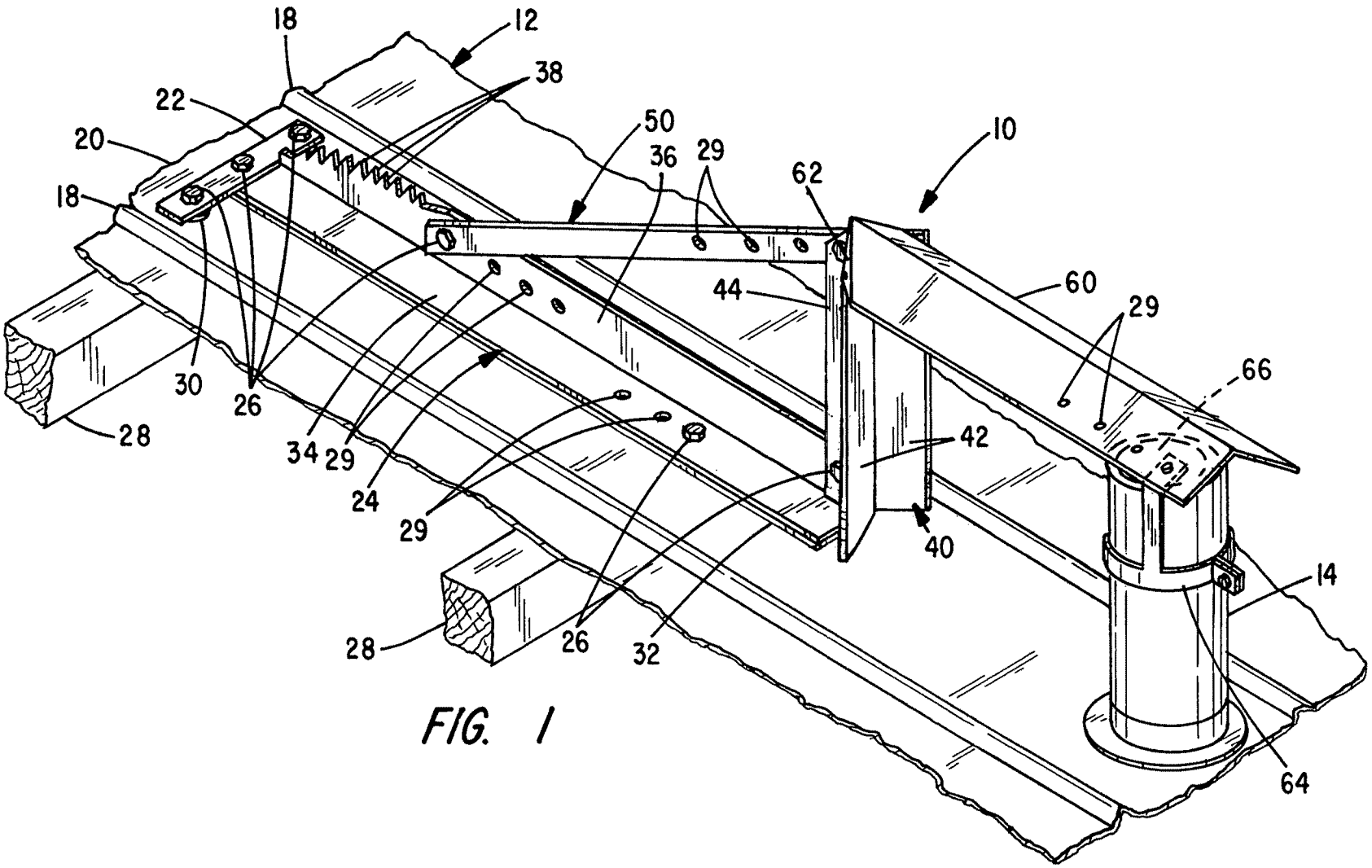
FIG. 1 shows a perspective view of a snow/ice diverter assembly of the invention mounted to a metal roof in the space between panel seams and upstream of a protruding vent pipe that is covered with an accessory cover piece.

With attention to the perspective view of FIG. 1, a roof mounted snow/ice diverter assembly 10 of the invention is shown as it appears when mounted to a typical pitched roof 12. The assembly 10 is typically mounted 24-inches or less upstream of a protruding appliance 14 such as a plumbing vent pipe 14 as (depicted) or antenna, chimney etc. The depicted roof 12 is constructed of a number of overlapping metal panels 16 that exhibit longitudinal seamed ridges 18. The appliances 14 are normally located to project in the channel space 20 between the ridges 18. The diverter assembly 10 correspondingly is mounted in the channel space 20 and is nominally positioned upstream and within 24-inches of the appliance 14.

A cross piece 22 secures a forward end of a webbed base plate 24 to the roof 12 with several fasteners 26 that are set into a lower lying purlin 28. An aft end of the base plate 24 is secured to an adjoining purlin 28 with other fasteners 26 fitted through an appropriately located aperture 29. Suitable compressible washers 30 mount between the cross piece 22 and roof panel 16. A layer of a compressible seal 32 mounts between a horizontal web 34 of the base plate 24 and roof 12. The roof 12 is thereby protected from any electrolysis or rust that might discolor the roof 12 or leaks at the fasteners 26. A variety of types of suitable fasteners 26 can be used to secure the diverter assembly 10 together and to the roof 12.

The depicted base plate 24 is constructed from an "L"-shaped aluminum member, nominally 20 to 36-inches in length and having nominal 3-inch horizontal web 34 and a 3-inch upright web 36. The base plate 24 might alternatively be constructed from a "T"-shaped member 37 shown in partial cutaway at FIG. 3. The length of the member and width of the webs 34 and 36 can be varied as desired. A series of serrations, points, spikes or saw teeth 38 are formed into the upright web 36 at progressively increasing heights to present an angularly ramped cutting edge to any sliding snow/ice front that impinges on the diverter assembly 10. The teeth 38 are shaped to cut and shear the full height of a snow/ice slide prior to reaching the appliance 14. Although a metal base plate 24 is presently preferred, a variety of other materials (e.g. UHMW plastic, polyethylene, plated or coated materials, etc.) might be used, provided the material is sufficiently slippery and durable to withstand the weight of a sliding snow/ice front and weather and UV conditions to which the material is subjected.

Figure 3:
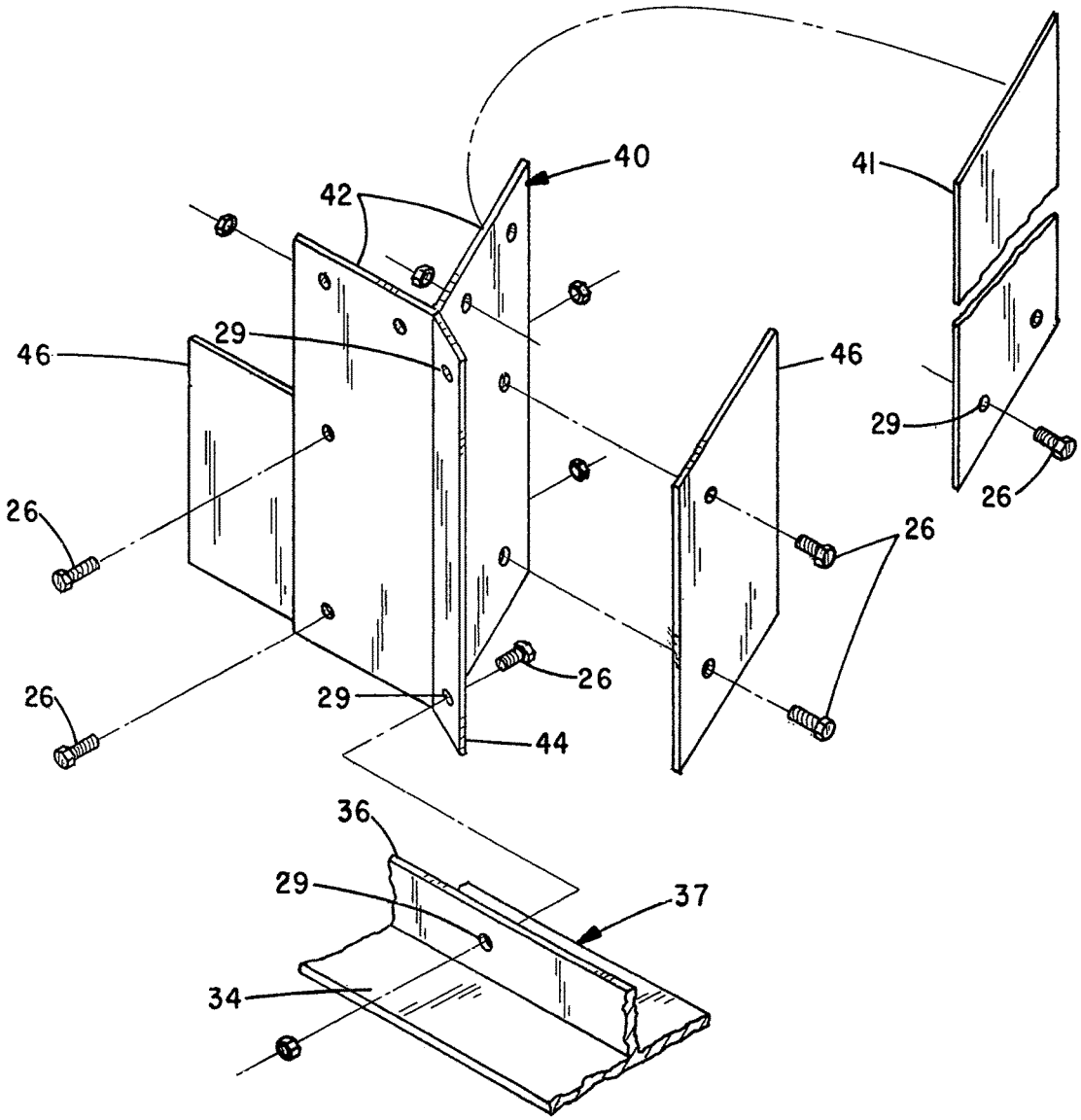
FIG. 3 shows a perspective view of the ice diverter plate of FIG. 1 with an attached forward brace member and detachable wing plates that mount to the diverter plate.

With additional attention to FIG. 3, mounted to the aft or downstream end of the base plate 24 is an upright, webbed diverter 40. The upright diverter 40 is presently constructed from 3-inch×3-inch aluminum "L"-shaped angle stock. The diverter nominally stands 10 to 20-inches above the base plate 24, although may include provisions for extending the height with additional extension pieces 41 that fasten to front or rear surfaces of the upper edges of the webs 42 of the diverter piece 40 to accommodate appliances 14 of differing heights and/or snow depths. Preferably the extension pieces 41 attach to the rear surface of the diverter piece 40 and project above any anticipated maximum snow cover.

The webs and/or wings 42 of the diverter 40 are positioned relative to the base plate 24 to present a plow-like or "V"-shape to the sliding snow/ice front to laterally displace the sections of sheared snow/ice away from the downstream appliance 14. The upright diverter 40 is particularly secured to the upright web 36 of the base plate 24 with fasteners 26 fitted through an aperture 29 in the upright brace member 44. The brace member 44 is welded to the project from the upstream intersecting edge of the web or wing pieces 42. The brace member 44 can include serrations 38, as desired. It is also to be appreciated the web pieces 42 can be positioned to intersect each other at any desired angle, although an angle in the range of 90° to 120° is presently preferred.

Also depicted at FIG. 3 are accessory wing pieces 46 that can be attached to front or rear side surfaces of the webs 42 with suitable fasteners 26 to expand the lateral diverting action of the upright diverter 40. Preferably the wing pieces 46 attach to the rear surface of the diverter piece 40. The wing pieces 46 produce greater lateral displacement of snow/ice to accommodate wider width appliances 14 such as larger diameter plumbing vent pipes or chimney pipes (e.g. 6 to 12 inches). Correspondingly as mentioned above and as necessary additional extensions 41 might be added to the diverter 40 to increase its height.

An upper end of the upright diverter 40 is secured to the base plate 24 via a stabilizer arm 50 that projects from an upstream end of the base plate 24. The stabilizer arm 50 is secured with fasteners fitted through provided apertures 29. The length and angular orientation of the stabilizer arm 50 relative to the upright diverter 40 can be adjusted as desired depending upon the apertures 29 selected. The stabilizer arm 50, like the brace member 44, strengthens the mounting of the upright diverter 40 and also facilitates the vertical separation of the sheared snow/ice front.

FIGS. 4 through 7 depict alternative constructions of the stabilizer arm 50. FIG. 4 depicts a stabilizer arm 50 constructed with serrated saw tooth-like points 38 formed along the length of the arm 50 to enhance the shearing action of the diverter assembly 10 relative to an impinging snow/ice front. FIGS. 5 and 6 depict a stabilizer arm 50 constructed with a wedged or knife edge 52 formed along the length of the arm 50 to enhance the shearing action of the diverter assembly 10 relative to an impinging snow/ice front. FIG. 7 depicts a multi-section, length adjustable stabilizer arm 50 constructed of overlapping pieces 54. The upstream piece 54 includes serrations 38 to enhance the shearing action of the diverter assembly 10 relative to an impinging snow/ice front. Serrations 38 can be provided at both arm pieces 54. The pieces 54 can be overlapped as desired to vary the length of the stabilizer arm 50 to accommodate different angular orientations relative to the base plate 24 and diverter 40.

Figure 2:
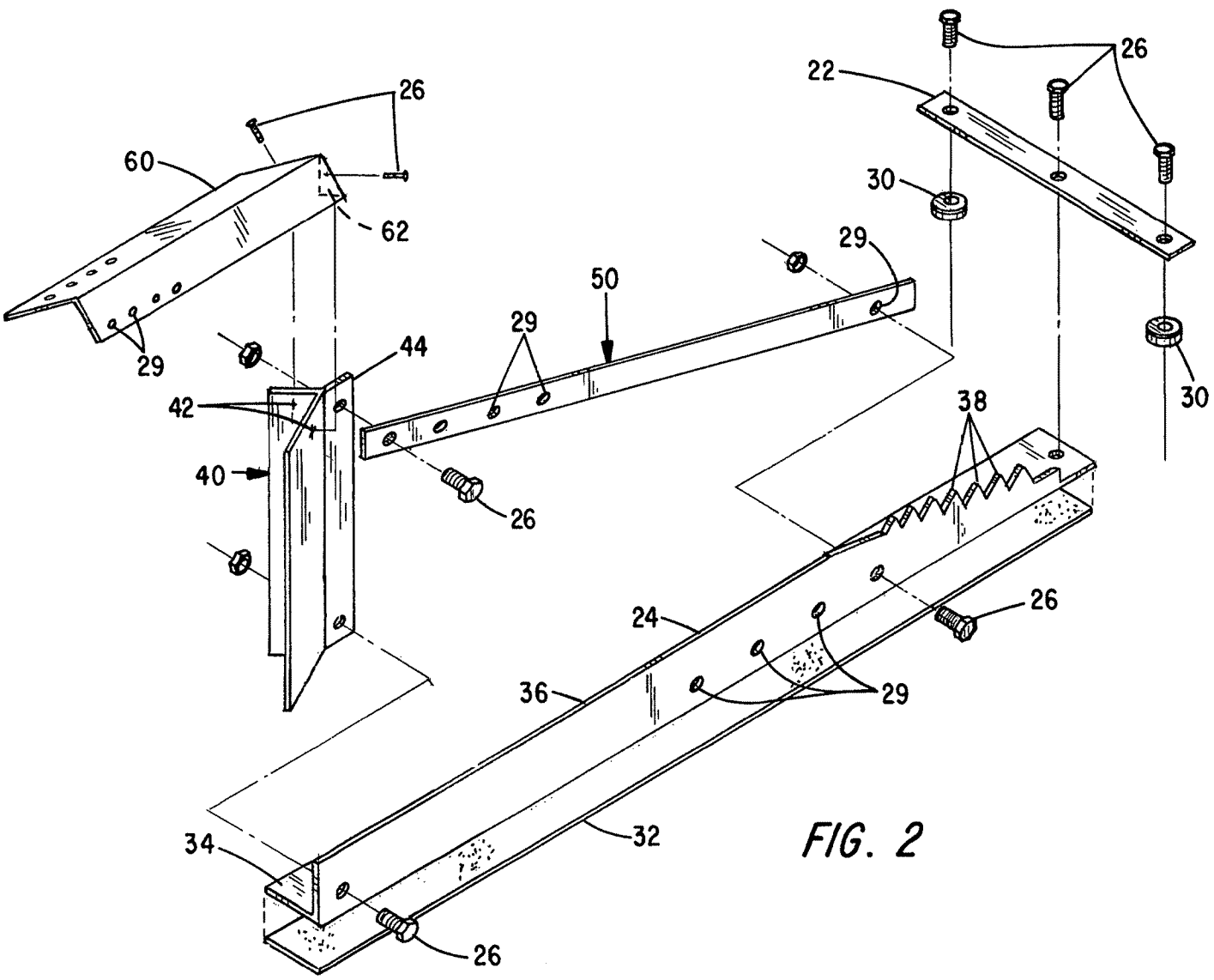
FIG. 2 shows a perspective assembly view of the ice diverter of FIG. 1 depicting the individual piece parts and there assembled orientations to one another.

Returning attention to FIGS. 1 and 2, an accessory cover or cap piece 60 is also shown that mounts to the upright diverter 40 and spans between the diverter 40 and appliance 14. The cover piece 60 is formed from a suitable material (e.g. metal or plastic) and is secured at a upper edges of the upright diverter 40 via flaps 62 that are formed to align with the webs 42. The cover 60 is sized to extend sufficiently to cover a bore 66 in the appliance 14. If desired, a band clamp 64 is shown that can be secured to the cover 60 via mating fasteners 26 and apertures 29 an appropriate distance downstream of the diverter 40. Once mounted to the cover 60, the clamp 64 is mounted to the appliance 14 to cover the bore 66. The clamp 64 may or may not be used as desired.

Figure 8:
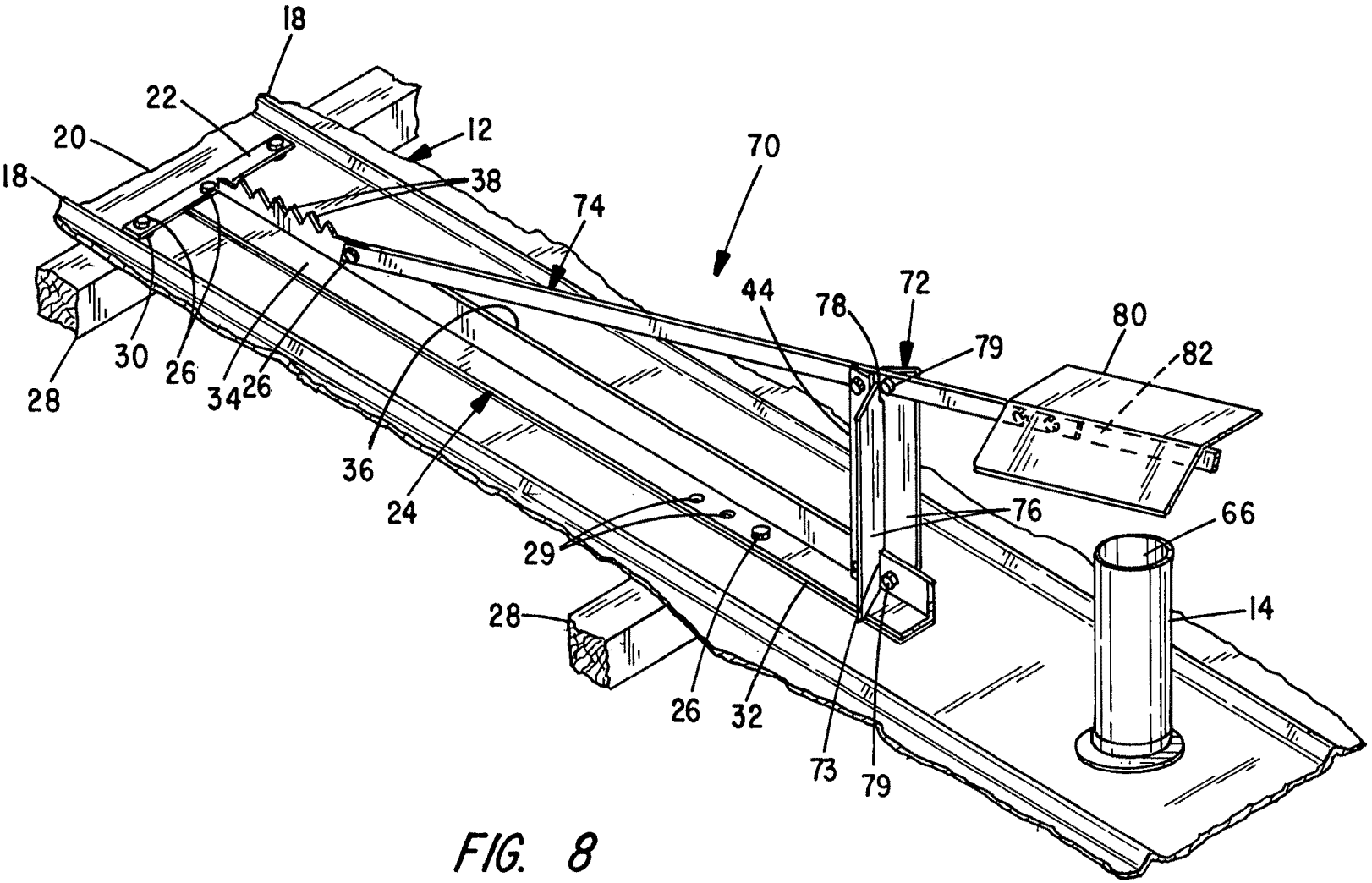
FIG. 8 shows a perspective view of an alternative construction of the snow/ice diverter assembly of the invention mounted to a metal roof in the space between panel seams and upstream of a protruding vent pipe that is covered with an accessory cover piece.
Figure 9:
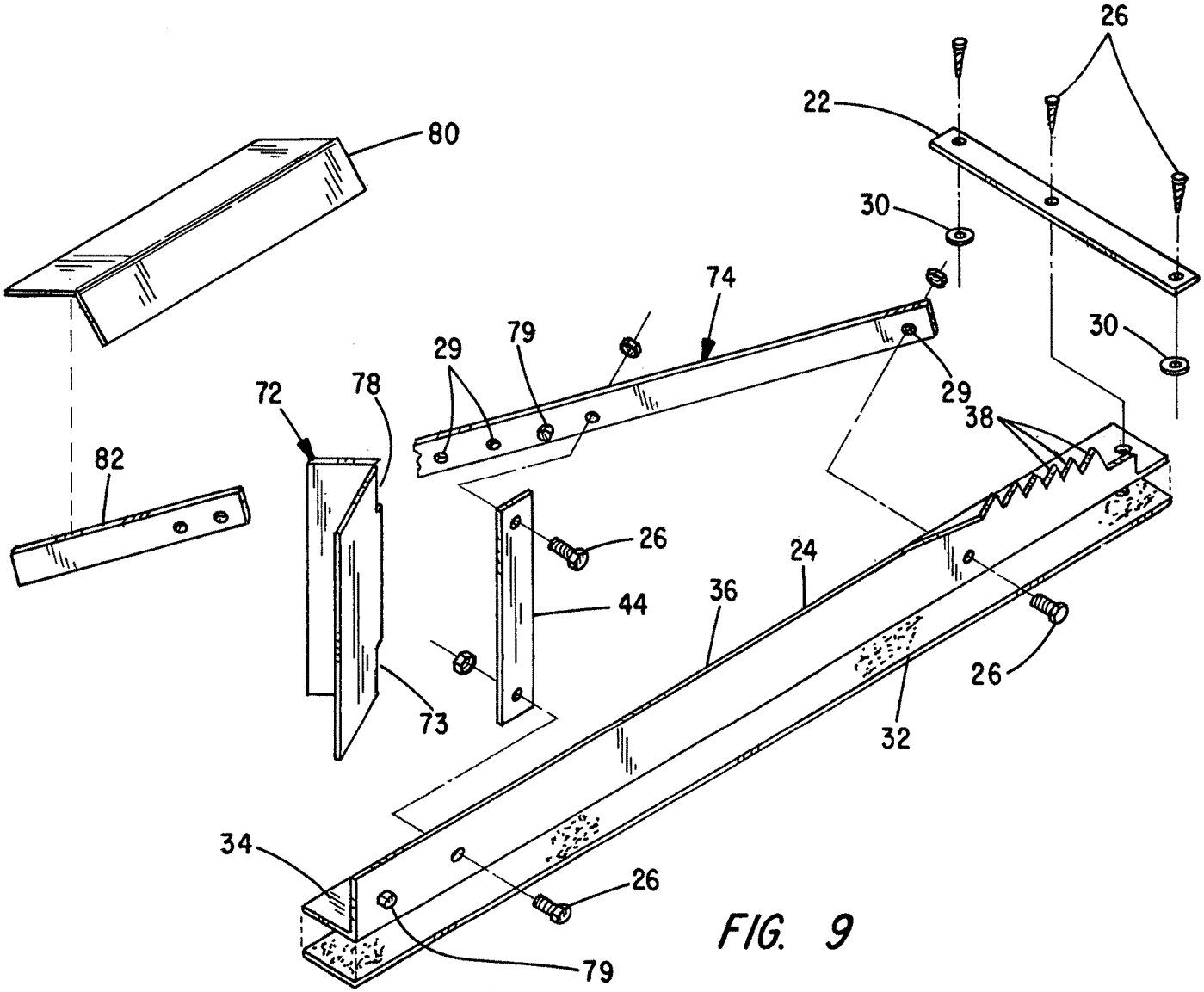
FIG. 9 shows a perspective assembly view of the ice diverter of FIG. 8 depicting the individual piece parts and there assembled orientations to one another.
Figure 10:
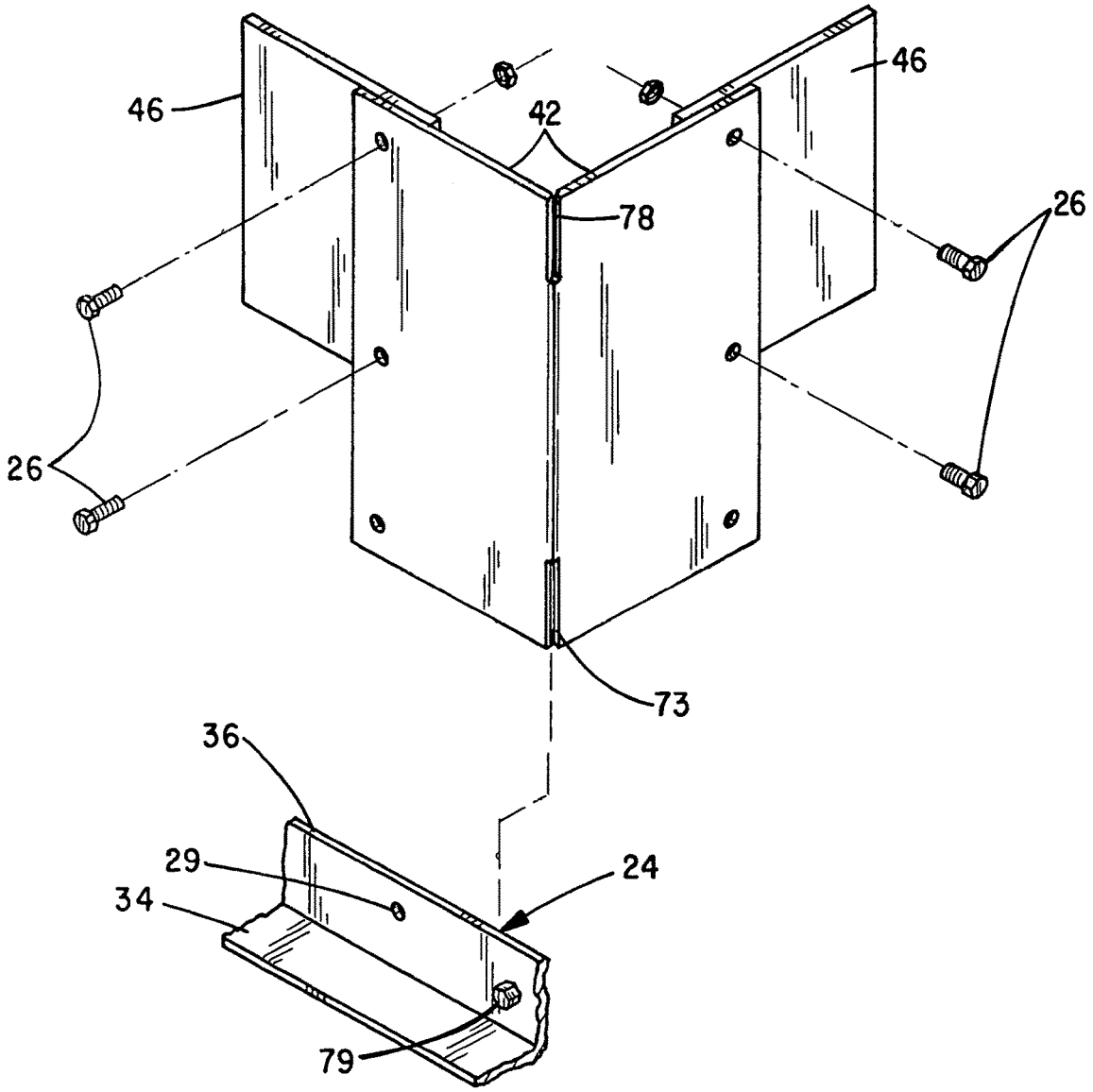
FIG. 10 shows a perspective view of the ice diverter plate with detachable wing plates that mount to the webs of the diverter piece.

Turning attention to FIGS. 8 through 10, views are shown to a presently preferred alternative construction of a diverter assembly 70 of generally similar construction to the assembly 10. The assembly 70 provides for a cross piece 22 and a serrated "L"-shaped base plate 24. A slotted vertical diverter 72 projects from the base plate 24 and a stabilizer arm 74 extends through a slot 78 in the upper end of the diverter 72. The diverter 72 is secured to the base plate 24 by the stabilizer arm 74, a brace member 44 and stop members 79 as described below.

With particular attention to FIGS. 9 and 10, a slot 73 in the lower end of the diverter 72 mounts over the web 36 of the base plate 24. The slot 73 is positioned between a forward brace member 44 and a stop member 79, both of which are secured to the web 36. The lower end of the diverter member 42 thus has some freedom of movement between the rigidly secured brace member 44 and the stop member 79. Wing pieces 46 may be mounted to the diverter webs 42 as desired.

A forward-end of the stabilizer arm 74 mounts to the upright web 36 of the base plate 24 aft of the serrations 38. A mid-portion of the stabilizer arm 74 is fitted into a slot 78 at the upper end of the diverter 72 between an aperture 29 and a stop member 79 that projects from the stabilizer arm 74. The stabilizer arm 74 is secured to the upright brace member 44 at the aperture 29. The brace member 44 is vertically aligned to the intersecting edge of the web pieces 76 of the diverter 72. An aft end of the stabilizer arm 74 extends through and floats in the upper slot 78 in the diverter 72.

The diverter 72 is thus trapped between the base plate 24 and the stabilizer arm 74 via the fastenings at the brace member 44 and the stop members 79. The diverter 72 has a slight freedom of movement which is desirable during ice/snow slides to promote diverting movement of the ice/snow. The angular orientation of the stabilizer arm 74 relative to the base plate 24 can also be varied depending upon a particular selection of apertures 29 through which the fasteners 26 are mounted.

Returning attention to FIG. 8, a cover piece 80 is shown that can be mounted to the stabilizer arm 74. The cover piece 80 is secured to an aft end of the stabilizer arm 74 that extends past the diverter 72. A cover support piece 82 is mounted to depend from a lower surface of the cover 80 and provides apertures 29, FIG. 9. Depending upon the separation of the appliance from the diverter assembly 70, the cover 80 is mounted to appropriate apertures 29 to suspend the cover 80 above the open bore 66 of the appliance 14.

While the invention has been described with respect to a presently preferred assembly and considered improvements, modifications and/or alternatives thereto, still other assemblies and arrangements may be suggested to those skilled in the art. It is therefore to be appreciated that the features of the foregoing diverter assembly can be arranged in different combinations to accommodate a variety of roof constructions and protruding appliances. The foregoing description should therefore be construed to include all those embodiments within the spirit and scope of the following claims.

What is claimed is:

1. Apparatus for protecting an upright appliance protruding through a roof comprising:

a) a longitudinal base plate having intersecting first and second web pieces wherein the first web piece is adapted to attach to a roof, wherein the second web piece projects upright to the first web piece, and wherein the second web piece includes a plurality of serrations exposed along an edge surface at a fore end thereof;

b) a diverter mounted to the base plate aft of the serrations to project upright above the base plate and including intersecting first and second diverter pieces, wherein an edge surface at an intersection of the first and second diverter pieces is secured to the second web piece such that the second web piece bisects the first and second diverter pieces and positions the first and second diverter pieces to laterally flare outward from opposite sides of the second web piece and toward an aft end of the base plate to exhibit a "V-shape" relative to the serrations and fore end of the base plate; and c) a stabilizer arm extending at an acute angle between and coupling the base plate to the diverter.

2. Apparatus as set forth in claim 1 wherein the diverter orthogonally projects from the base plate.

3. Apparatus as set forth in claim 1 wherein the first and second web pieces of the base plate exhibit an L or T shaped edge profile when viewed end-on.

4. Apparatus as set forth in claim 1 including a cover member secured to the stabilizer arm aft of the base plate.

5. Apparatus as set forth in claim 1 wherein said diverter includes first and second slots in respective upper and lower ends of the edge surface between the first and second diverter pieces, wherein said second web piece mounts in said first slot, and wherein said stabilizer arm mounts in said second slot.

6. Apparatus as set forth in claim 5 wherein said second web piece and said stabilizer arm include stop members, and wherein said first and second slots are mounted forward of said stop members.

7. Apparatus as set forth in claim 1 including first and second wing pieces mounted to extend parallel to and from the first and second webs of the diverter piece.

8. Apparatus as set forth in claim 1 including an extension piece mounted to an upper end of the diverter piece to extend the height thereof.

9. Apparatus as set forth in claim 1 including a cross piece mounted transverse to said base plate and adapted to attach to the roof.

10. Apparatus as set forth in claim 9 including a plurality of compressible seals mounted to the bottom surfaces of said base plate and cross piece.

11. Apparatus as set forth in claim 1 wherein the first and second web pieces of said base plate exhibit an "L" shaped profile when viewed end-on.

12. Apparatus for protecting an upright appliance protruding through a roof comprising:

a) a longitudinal base plate having intersecting first and second web pieces, wherein the first web piece is adapted to attach to a roof, wherein the second web piece orthogonally projects upright to the first web piece and wherein a fore end of the second web piece includes a plurality of serrations exposed along an upper edge surface;

b) a diverter mounted to orthogonally project aft of said serrations and above said base plate comprising first and second intersecting diverter pieces, wherein an edge surface at an intersection of the first and second diverter pieces is secured to the second web piece such that the first and second diverter pieces laterally flare outward from opposite sides of said second web piece and toward an aft end of the base plate to exhibit a "V-shape" relative to the serrations and fore end of the base plate.

13. Apparatus as set forth in claim 12 including a stabilizer arm extending at an acute angle aft of said serrations of the second web piece to an upper end of the intersecting edge surface of the first and second diverter pieces.

14. Apparatus as set forth in claim 13 wherein the diverter includes first and second slots in respective upper and lower ends of the intersecting edge surface between the first and second diverter pieces, wherein said second web piece mounts in said first slot, and wherein said stabilizer arm mounts in said second slot.

15. Apparatus as set forth in claim 14 wherein said second web piece and said stabilizer arm include stop members, and wherein said first and second slots are mounted forward of said stop members.

* * * * *